United States Patent [19]

Schmid

[11] 4,002,303

[45] Jan. 11, 1977

[54] DEVICE FOR SECURING THE WINDING ENDS OF ELECTRICAL COILS ON TERMINAL PINS

[75] Inventor: Hans Schmid, Ruschlikon, Switzerland

[73] Assignee: A. Christiaens Societe Anonyme, Brussels, Belgium

[22] Filed: Apr. 16, 1975

[21] Appl. No.: 568,657

[30] Foreign Application Priority Data

Apr. 23, 1974 Switzerland ..... 5530/74

[52] U.S. Cl. ..... 242/7.17

[51] Int. Cl.[2] ..... H01F 41/10

[58] Field of Search ..... 242/7.17, 7.03; 140/119, 124, 92.2

[56] References Cited

UNITED STATES PATENTS

| | | | |
|---|---|---|---|
| 2,648,356 | 8/1953 | Beaulieu et al. | 242/7.17 |
| 2,688,449 | 9/1954 | Haagensen | 242/7.17 |
| 2,725,198 | 11/1955 | Reck | 242/7.17 |
| 3,117,736 | 1/1964 | Loy et al. | 242/7.17 |
| 3,700,010 | 10/1972 | Bartilson et al. | 140/119 X |

*Primary Examiner*—George F. Mautz

*Attorney, Agent, or Firm*—Sughrue, Rothwell, Mion, Zinn & Macpeak

[57] ABSTRACT

A device for securing the winding ends of coils on terminal pins of the coil body comprising a rotatably driven coiling member having an axial aperture for receiving a terminal pin, a groove extending axially through the coiling member and arranged eccentrically with respect to the axis of rotation of the coiling member, for accommodating the end of a winding, the groove being alignable on rotation of the coiling member with a longitudinal slot in a bearing of the coiling member so as to allow the winding end to pass through the slot into the groove.

17 Claims, 5 Drawing Figures

TO MICROSWITCH 44 (FIG. 1)
CLIP

DEVICE FOR SECURING THE WINDING ENDS OF ELECTRICAL COILS ON TERMINAL PINS

BACKGROUND OF THE INVENTION

1. Field of the Invention

The invention relates to a device for securing the winding ends of electrical coils on terminal pins on a coil body, by wrapping one of the winding ends around a terminal pin.

2. Description of the Prior Art

In a known device a rotatably-supported drivable coiling member has an axial aperture for accommodating the terminal pin, and an eccentric bore, which is substantially parallel to the axis of rotation, for accommodating a winding end. During the coiling operation, the bore functions as a wire guide but the coiling member does not rotate but traverses slowly to and fro along the coil body which is to be wound. The axial aperture of the coiling member is moved over the terminal pin on completion of the winding operation and the coiling member is rotated. The result of this rotation is that the wire passing through the bore is coiled around the terminal pin, i.e. the end of the coil winding is secured on the terminal pin.

It is clear that such a device can in practice be used only on coil winding machines in which the coil winding operation is performed by rotation of the coil body and it is also clear that such a device can hardly be used on a coil winding machine which operates in a manner of a ring spinning machine, i.e. with a stationary coil body and a wire supply which literally rotates around the coil body.

This is not the only disadvantage of the known device. It is a consequence of the above-mentioned method of operation that it permits either only coiling or only the operation of securing the winding ends on the terminal pins. This may be acceptable in single-spindle coil winding machines, but the described method of operation represents a loss of coil winding time if such a machine has more than one operating station.

It is feasible to use the known device in a duplex embodiment (with two wire supplies) and to operate the coiling members alternately as wire guide and as the actual members for wrapping wire around the terminal pins. This method of operation which is theoretically feasible but calls for a substantial expenditure is also subject to disadvantages. After a winding end has been secured, it is necessary for the wire to be cut. The wire end which remains in the bore of the coiling element and now advances must be retained, unless a "threading-up" operation is interposed prior to each new coil winding operation, and the wire must then be secured on the terminal pin for the beginning of the operation of winding the next coil.

As already indicated, these remarks apply to conventional coil winding machines. If the known device were to be adapted to a so-called flyer coil winding machine with stationary coil bodies disposed on a transfer line and being supplied to the coil winding station in serial succession, it would be necessary to cut the wire section extending from coil to coil before securing it to the terminal pins, to insert each of the two wire ends thus produced into the bore of the coiling element and only then to secure the winding ends to the terminal pins.

SUMMARY

The invention provides a device for securing the ends of electrical coils on terminal pins of a coil body comprising bearing means, a coiling member rotatably mounted in said bearing means, drive means for rotating said coiling member, an axial aperture in said coiling member and extending along the axis of rotation thereof for accommodating a terminal pin, a longitudinal slot in said bearing means, and a groove extending axially through said coiling member and arranged eccentrically with respect to said axis of rotation for accommodating the end of a winding, said groove being alignable on rotation of said coiling member with said longitudinal slot to allow said winding end to pass through said slot into said groove.

Thus "threading-up" of a wire end is not required and the wire does and according does not even need to be cut in order to wrap the winding ends around the terminal pins.

DESCRIPTION OF THE PREFERRED EMBODIMENT

Figure 1:
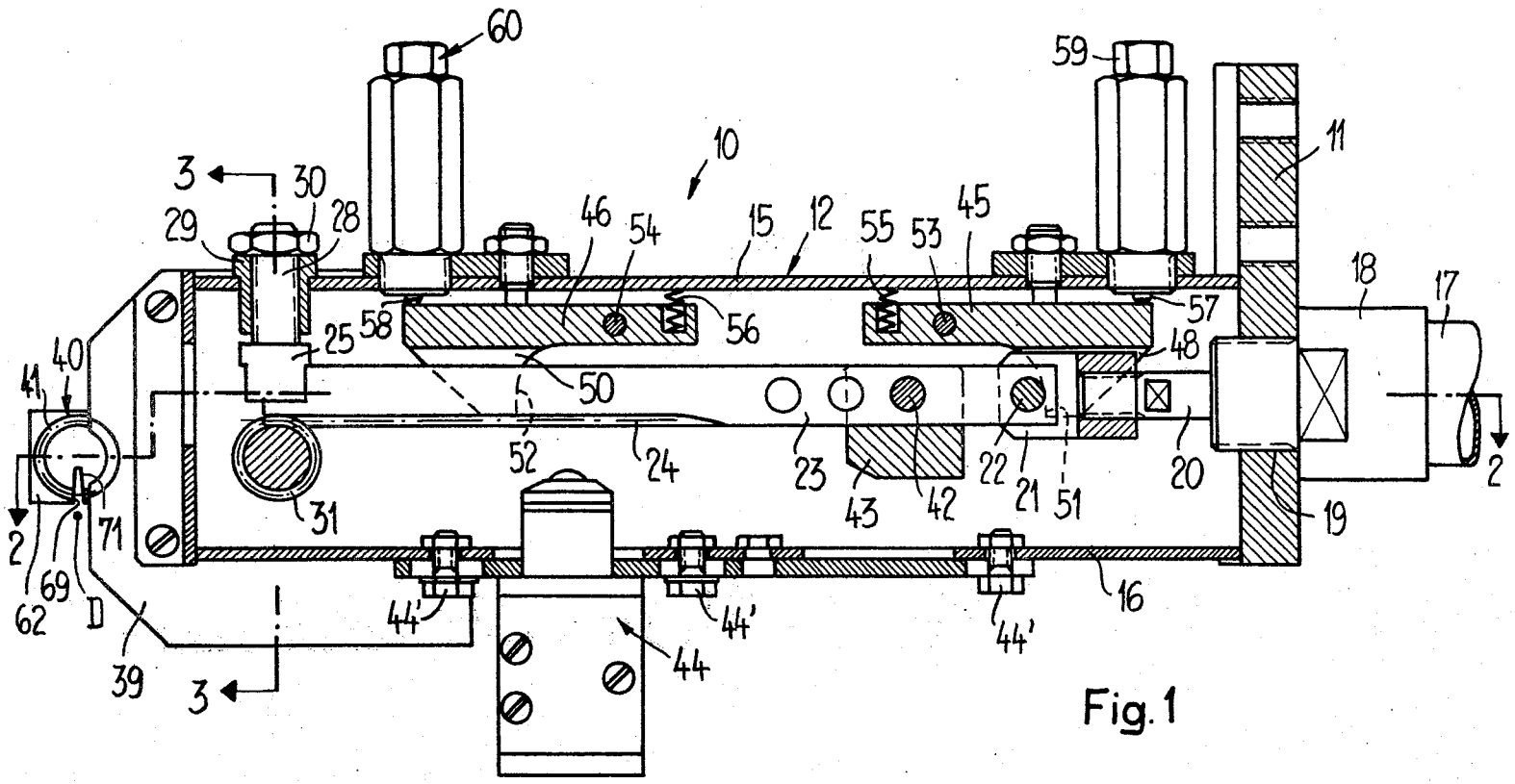
FIG. 1 is a longitudinal section through a device suitable more particularly for attachment to automatic coil winding machines adapted to operate in accordance with the flyer principle and having a plurality of operating stations.

In the device 10 illustrated in FIGS. 1 to 4, a narrow, elongated housing 12, comprising two side plates 13, 14 (FIG. 2) a cover plate 15 and a bottom plate 16, is mounted on one side of a mounting flange 11. A hydraulic or pneumatic cylinder 17 is mounted on the other side of the flange 11 and has an end member 18 screw-mounted into a bore 19 in the flange 11. A coupling piece 21, to which a push rod 23 is coupled by means of a pin 22, is screw-mounted on the free end of a piston rod 20 of the cylinder 17. As may be seen in FIG. 1, half of the push rod 23 on the left-hand side of the drawing is provided with teeth 24 along its under surface, while the opposite top surface of the push rod 23 is slidably guided in a guide shoe 25. The guide shoe 25 has a stud 26 (FIG. 3), which is inserted into a blind hole 27 in a bolt 28. The bolt 28 is screw-mounted in a screw-threaded bush 29, which is secured in position in the cover plate 15 by means of a nut 30. The guide shoe 25 acts on the push rod 23 directly opposite to where the teeth 24 mesh with a pinion 31.

Figures 2, 3, 4, 5:
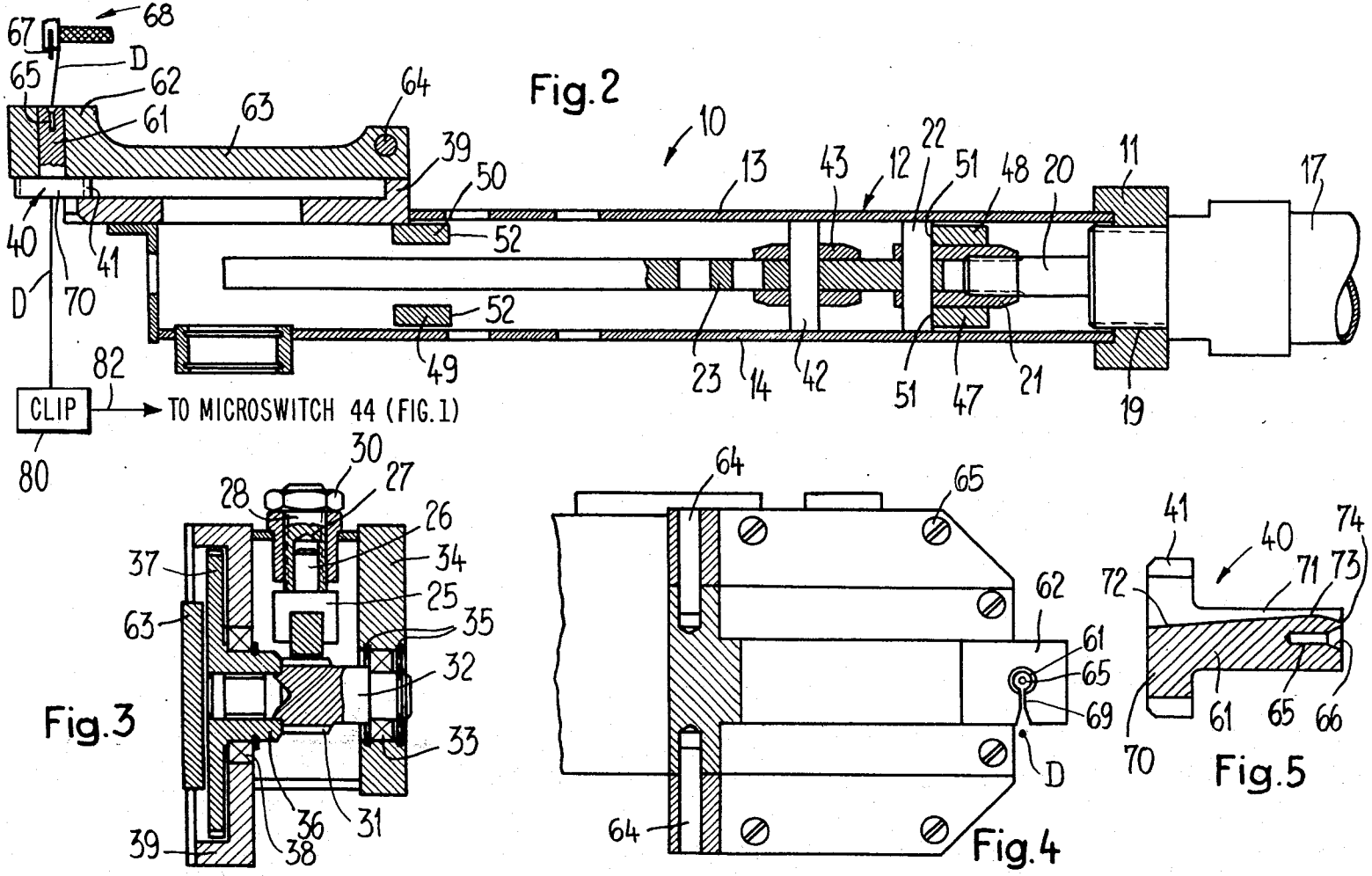
FIG. 2 is a section along the line 2—2 of FIG. 1.
FIG. 3 is a section along the line 3—3 of FIG. 1.
FIG. 4 is a view from the rear of part of the device on the left-hand side of FIG. 1.
FIG. 5 is an enlarged longitudinal section of a preferred coiling member used in the device according to FIGS. 1 to 4.

As may be seen from FIG. 3, the pinion 31 is constructed integrally with a shaft 32, one end of which (the right-hand end in FIG. 3) is rotatably supported in a rolling bearing 33, which is arranged in a bearing support 34, mounted on the side plate 14, and is secured thereto by means of circlips 35. The hub 36 of a gearwheel 37 is screw-mounted on the other end (the left-hand end in FIG. 3) of the shaft 32. The hub 36 is rotatably supported in a rolling bearing 38. The rolling bearing 38 is mounted on a bearing support 39, which is mounted on the side plate 13.

The shaft 32 with the pinion 31 and the gearwheel 37 is not shown in FIG. 2. The bearing support 39 and the space into which the gearwheel 37 fits is however visible. The gearwheel 37 meshes with external teeth 41 of a winding member 40 which will be described in detail below.

As can be seen from FIG. 2, the pin 22, connecting the coupling piece 21 to the push rod 23, extends on both sides beyond the coupling piece 21 close to the inside surfaces of the side plates 13, 14. A trip 43 which projects laterally from the push rod 23 is mounted thereon by means of a pin 42. The purpose of the trip 43 is to operate a microswitch or control valve 44 at the end of the operating stroke of the piston rod 20 and hence of the push rod 23. The microswitch 44 is lockably mounted on the bottom plate 16 by means of clamping screws 44' so as to be slidable in the direction of shape of the push rod 23. The purpose of the microswitch or control valve 44 is to trigger in an automatic coil winding machine (not shown) in which the illustrated device represents one operating station, those operations which depend on the operating stroke of the push rod 23 being reached.

As can be seen in FIG. 2, the pin 42 also extends on both sides beyond the trip 43 close to the inside of the side plates 13 and 14.

Two stop members 45, 46 (FIG. 1) are associated with the push rod 23 and the pins 22, 42. The stop members 45, 46 each have a bifurcated end having members 47, 48 and 49, 50 respectively, which extend into the path of movement of the ends of the pins 22 or 42. As a result, the movement of the push rod 23 in FIGS. 1 and 2 is limited by the ends of the pin 22 bearing on stop abutment surfaces 51 of the members 47 and 48, and by the ends of the pin 42 striking stop abutment surfaces 52 of the members 49 and 50. FIG. 1 shows that the stop members 45 and 46 are pivotably supported on pivoting pins 53 and 54 respectively, which extend between the side plates 13 and 14. A spring 55, 56 pivots the stop member 45, 46 against end 57, 58 of an adjusting screw 59, 60 respectively. The screws 59, 60 can be adjusted from above the cover plate 15. It is possible to adjust the distance between the stop abutment surfaces 51 and 52 and therefore the length of the operating stroke of the push rod 23 very accurately, namely within fractions of a millimetre, by means of the adjusting screws 59 and 60. The significance of such adjustability will be apparent from the description below.

The coiling member 40, which is essentially a pinion having peripheral teeth 41, has a shaft 61, extending laterally on one side of the member 40. The shaft 61 is supported for free rotation in a bearing support 62, which is a thickened portion at one end of an arm 63. The arm 63 is hinged to the bearing support 39 so as to be pivotable about a pivoting pin 64. The arm 63 is secured in an operating position by means of screws 65 (FIG. 4) thus preventing any pivoting motion. In this operating position, the end of the bearing support 39 (FIGS. 1 and 2) projects a little way over the side of the pinion 41 remote from the hub 61, thus preventing the pinion 41 from coming out of the bearing support 62 due to axial displacement. As shown in FIG. 2, and more particularly in FIG. 5, the free end of the hub 61 has a central bore 65 with a countersunk portion 66. The purpose of the bore 65 (when the device is in operation), is to accommodate and guide a terminal pin 67, which projects from a flange of a wound coil 68 as shown on the left-hand edge of FIG. 2. FIGS. 1 and 4 also show that the bearing support 62 is provided with a slot 69 situated approximately in the plane of the axis of rotation of the coiling member 40 and extending over the entire length of the hub 61. The slot 69 has side edges which converge towards the hub 61. (FIG. 4). An axial grove 71 (FIG. 5) which extends over the entire length of the coiling member 40, is formed in the hub 61 as well as in the wheel part 70 of the coiling member 40. In the present case, and as shown in FIG. 5, the floor 72 of the axial groove 71 does not extend parallel to the axis of rotation of the coiling member 40. The end of the floor 72 remote from the bore 65 almost coincides with the axis of rotation of the coiling member 40. From this end inwards the floor 72 diverges progressively from the axis of rotation up to a rounded apex 73 situated approximately half way along the bore 65, and then again approaches the axis of rotation in order to terminate in a sharp a cutting or tear-off edge 74 on the end face of the hub 61.

The longitudinal edges of the groove 71 and the end edge thereof opposite to the cutting edge 74 are preferably rounded. Furthermore, the width of the groove 71 is greater than the minimum width of the slot 69.

OPERATION

Before the apparatus 10 is put into operation, the stop members 45 and 46 are set inter alia so that at the end of each stroke of the push rod 23 the axial groove 71 in the coiling member 40 is accurately aligned with the slot 69 in the bearing support 62 as shown in FIG. 1. In operation, the device 10 is moved relative to the coil 68 so that the terminal pin 67 (FIG. 2) enters the bore 65. The end of the winding, which extends away from the coil 68 in the form of a wire piece D, then passes through the slot 69 into the axial groove 71. As soon as this position is reached, the cylinder 17 is actuated to move the push rod 23 to the left in FIG. 2 and to cause rapid rotation of the coiling member 40 via the gearwheel 37. Since the floor 72 of the axial groove 71 is eccentric over its entire length with respect to the axis of rotation of the coiling member 40, the wire piece D is closely twisted around the terminal pin 67, which extends through the bore 65, the wire required to this end being obtained from the side which faces away from the coil 68. It should be noted that no free wire end is required for this operation. The wire supply required for wrapping around the terminal pin 67 is present in a spring-biased loop which follows the coil 68. As soon as the supply in the loop comes to an end, or if the spring tension in the wire D has increased to a specific value, the section of the wire guided by the coiling member 40 will bear under increasing stress on the floor 72 of the coiling member 40. This increasing stress causes the wire to tear off against the tear-off edge 74, i.e. close to the terminal pin 67. This produces two wire ends one of which is situated close to the terminal pin 67 while the other is retained by a clip 80 operated, for example, via electrical line 82 by control means such as the microswitch 44 and adapted to grip the remainder of the reserve loop so that the device 10 is ready for securing a new winding end without the need for "threading-up".

MODIFICATION

Although alignment of the axial groove 71 with the slot 69 in the illustrated embodiment is facilitated by the use of a positive drive for the coiling member 40, it is also possible to provide other means, when using a non-positive drive, in order to align the slot 69 with the axial groove 71, at least at the beginning of an operating cycle. If it is desired to wrap wire around the terminal pins 67 not with a random but with an orderly configuration in which each turn adjoins the other, it is possible to provide a fine screwthread on the external diameter of the hub 61, this screwthread being matched with internal screw-threading in the bearing support 62. In this case, the width of the teeth 41 would have to be greater because the coiling member 40 would perform a short axial motion in addition to its rotating motion.

I claim:

1. Device for securing the ends of electrical coils on terminal pins of a coil body comprising:

bearing means having a longitudinal aperture extending the full length of said bearing means, a coiling member having a shaft portion of said length rotatably mounted in said bearing means aperture, drive means for rotating said coiling member, an axial recess in said coiling member and extending along the axis of rotation thereof for accommodating a terminal pin, a longitudinal slot in said bearing means and extending longitudinally in radial communication with said aperture for said full length, and a groove, separate from said recess, extending axially all the way through said coiling member and arranged eccentrically with respect to said axis of rotation for accommodating the end of a winding, said groove being alignable on rotation of said coiling member with said longitudinal slot to allow said winding end to pass through said slot into said groove.

2. Device according to claim 1, wherein said coiling member is a wheel and a hub which includes said shaft portion and extends from one side of said wheel into said bearing means aperture as aforesaid, said drive means imparting rotation to said coiling member via the periphery thereof.

3. Device according to claim 2, wherein said wheel is a pinion and said drive means comprise rack drive means.

4. Device according to claim 3, wherein said rack drive means comprise a reciprocatingly-drivable rack.

5. Device according to claim 4, comprising stop means for limiting the reciprocating movement of said rack and aligning said groove in the coiling member with said longitudinal slot in the bearing means in at least one limiting position of said rack.

6. Device as claimed in claim 5, wherein said stop means are adjustable in the direction of movement of the rack, means being provided for holding said stop means in any required adjustment.

7. Device according to claim 1, wherein said axial recess in said coiling member extends inwardly from one end face thereof for a distance substantially less than said length, and a floor of said groove inclines toward said axis of rotation at an opposite end face of said coiling member.

8. Device according to claim 7, comprising a cutting edge for the wire end at said one end face between said axial aperture and the floor of said groove.

9. Device according to claim 7, comprising a groove floor apex towards which said groove floor diverges constantly from said axis of rotation in a direction away from said opposite end face of said coiling member and away from which said groove floor converges towards said axis of rotation in a direction towards said one end face.

10. Device according to claim 8, wherein longitudinal end edges of said groove, apart from said cutting edge, are rounded.

11. Device according to claim 1, wherein sides of said longitudinal slot diverge outwardly of said coiling member.

12. Device according to claim 11, wherein the width of said groove in said coiling member is greater than the minimum width of said longitudinal slot in said bearing means.

13. Device according to claim 4, comprising a transmitting gear chain means between said rack and said pinion.

14. Device according to claim 2, wherein said drive means comprise a positive reciprocating drive for said wheel.

15. Device for securing the ends of electrical coils on terminal pins of a coil body comprising:

bearing means having an aperture, a coiling member rotatably mounted in said bearing means aperture, drive means for rotating said coiling member, an axial recess in said coiling member and extending inwardly from one face of said coiling member along the axis of rotation thereof for accommodating a terminal pin, a longitudinal slot in said bearing means communicating radially with said aperture, and a groove extending axially throughout said coiling member with a floor arranged eccentrically with respect to said axis of rotation for accommodating the end of a winding, said groove floor having an apex away from which said floor coverges towards said axis of rotation in a direction towards said one face and towards which apex said floor diverges constantly from said axis of rotation in a direction away from an opposite end face of said coiling member, said groove being alignable on rotation of said coiling member with said longitudinal slot to allow said winding end to pass through said slot into said groove.

16. Device for securing the wire at the end of an electrical coil on a terminal pin of a coil body comprising:

bearing means, a coiling member rotatably mounted in said bearing means, drive means for rotating said coiling member, an axial recess in one end of said coiling member and extending along the axis of rotation thereof for accommodating a terminal pin, a longitudinal slot in said bearing means, and a groove extending axially all the way through said coiling member and arranged differentially eccentrically throughout at least most of its length with respect to said axis of rotation for accommodating said wire, said groove being alignable on rotation of said coiling member with said longitudinal slot to allow said wire to pass through said slot into said groove.

17. Device according to claim 16 wherein the floor of said groove slopes toward said rotation axis in a direction towards an opposite face of said coiling member, and said device further includes clip means adjacent an opposite end of said coiling member for gripping said wire and control means operated by said drive means for actuating said clip means when said drive means has rotated said coiling member a predetermined number of revolutions.

* * * * *

UNITED STATES PATENT OFFICE

CERTIFICATE OF CORRECTION

Patent No. 4,002,303 Dated January 11, 1977

Inventor(s) Hans Schmid

It is certified that error appears in the above-identified patent and that said Letters Patent are hereby corrected as shown below:

In the Heading

Item [73], should read -- Assignee: Meteor AG, Ruschlikon, Switzerland --.

As to Attorney, Agent, or Firm, change "Sughrue, Rothwell, Mion, Zinn & Macpeak" to read -- Cushman, Darby & Cushman --.

Signed and Sealed this Nineteenth Day of April 1977

[SEAL]

*Attest:*

RUTH C. MASON
*Attesting Officer*

C. MARSHALL DANN
*Commissioner of Patents and Trademarks*